US009308433B2

(12) United States Patent
Nobile

(10) Patent No.: US 9,308,433 B2
(45) Date of Patent: Apr. 12, 2016

(54) FRONT UNIT FOR A BINDING DEVICE AND RETRACTABLE PINS DEVICE

(71) Applicant: Salewa Sport AG, Herisau (CH)

(72) Inventor: Pascal Nobile, Laffrey (FR)

(73) Assignee: SALEWA SPORTAG, Herisau (CH)

( * ) Notice: Subject to any disclaimer, the term of this patent is extended or adjusted under 35 U.S.C. 154(b) by 0 days.

(21) Appl. No.: 14/717,175

(22) Filed: May 20, 2015

(65) Prior Publication Data

US 2015/0335987 A1 Nov. 26, 2015

(30) Foreign Application Priority Data

May 20, 2014 (FR) ..... 1401140

(51) Int. Cl.

*A63C 9/08* (2012.01)
*A63C 9/22* (2012.01)
*A63C 9/086* (2012.01)

(52) U.S. Cl.

CPC ..... *A63C 9/22* (2013.01); *A63C 9/0805* (2013.01); *A63C 9/086* (2013.01); *A63C 9/0807* (2013.01)

(58) Field of Classification Search

CPC .. A63C 9/086; A63C 9/0846; A63C 9/08535; A63C 9/08585

See application file for complete search history.

(56) References Cited

U.S. PATENT DOCUMENTS

| | | | | |
|---|---|---|---|---|
| 3,870,327 | A | 3/1975 | Betschart | |
| 3,905,613 | A * | 9/1975 | Romeo | A63C 9/0846 280/613 |
| 6,957,827 | B2 * | 10/2005 | Kogler | A63C 9/20 280/613 |

FOREIGN PATENT DOCUMENTS

| | | |
|---|---|---|
| DE | 2225564 | 2/1973 |
| DE | 3141425 | 11/1982 |
| DE | 3227237 | 1/1984 |
| DE | 102009059968 | 6/2011 |

OTHER PUBLICATIONS

French Patent Application No. 1401140, "Search Report" dated May 9, 2015.

French Application No. 1401140, "Search Report", mailed Mar. 9, 2015.

European Application No. EP15168446.1 , European Search Report dated Sep. 23, 2015, 8 pages.

* cited by examiner

*Primary Examiner* — Bryan Evans

(74) *Attorney, Agent, or Firm* — Kilpatrick Townsend & Stockton LLP

(57) ABSTRACT

The present invention provides a front unit of a binding for a touring ski. The invention relates to a front unit assembly of a binding on the front end of a sports shoe (30) on a gliding or rolling device (20), comprising:

Figure 1:
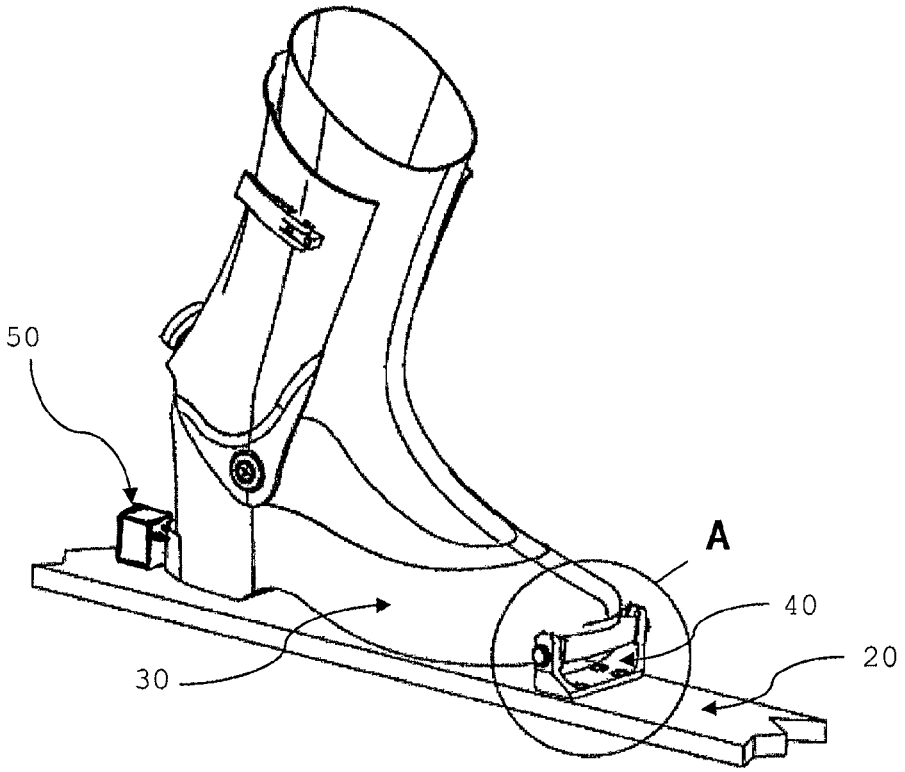

a set of retractable pins capable of being housed within a sports shoe, comprising two pins (3) that are each able to slide at least 1.5 mm into a bushing, intended each to be inserted into a recess (6) of a front unit (40), and a spring (2) which acts to separate the two pins (3).

a front unit comprising a rigid U-shaped frame (5), a recess (6) on each of the vertical parts of the frame (5) capable of engaging with the pin (3) of the shoe (30), and a release system embedded in each recess (6), comprising a screw (7), a button (8) and a gasket (9), said release system being able to move at least 1.5 mm along the axis of the recess (6).

16 Claims, 9 Drawing Sheets

FRONT UNIT FOR A BINDING DEVICE AND RETRACTABLE PINS DEVICE

The object of the invention is an assembly comprising an insert with retractable pins for a sports shoe, a sports shoe and a front unit, intended to reversibly connect the front end of a sports shoe to a gliding or rolling device, enabling rotation of the shoe around an axis situated on the front end of the shoe, transverse to the walking direction and approximately parallel to the gliding or rolling device. This assembly is specifically adapted for the practice of ski touring but may also be used for Nordic skiing, cross-country skiing, telemark skiing and roller skiing.

The nearest prior art is the type of ski touring binding that is designed with a front unit and a heel end in two distinct parts. The front units of these bindings require the presence of hollow inserts placed on both sides of the front end of the shoe. Analysis of the prior art focuses on the front units of this binding family which fall into two types:

The type of front unit which is based on the concept of patent EP0199098. The mechanism forms a jaw with each of its lever arms being equipped with a pin that lodges in the hollow insert of the shoe when the binding is closed. In this position, the binding connects the shoe to the ski by forming a hinged joint whose axis, passing through the hollow inserts, is transverse to the walking direction and approximately parallel to the gliding device. The clamping force of the jaw is created by a spring system placed between the two lever arms. The closing of the binding is triggered by the pressure of the shoe on the centre of the binding, causing tilting of the lever arms and the spring system; the pins then contact the bottom of the shoe's hollow inserts. Opening is effected by another lever situated on the front part of the binding which permits opening of the lever arms and reloading of the springs, comprising a cam system to enable the binding to be locked in order to avoid it opening unexpectedly while walking. The disadvantages of this type of binding are:

- its significant weight in relation to the present invention and the manufacturing cost owing to the complex mechanism.
- that snow, ice and/or mud can accumulate in the hollow inserts while the user is walking without having skis attached to the shoes, making it impossible or difficult to clip into the skis.
- that the spring system and specifically the part in which it moves can fill with snow and ice, preventing complete closure of the binding.
- the difficulty of clipping in because this action requires the user to precisely position the shoe over the binding, and to do so without mechanical guidance of the shoe.

The type of front unit which is based on the principle of patent FR2945185. The binding is a U-shaped leaf spring with two pins fixed on each vertical part of the leaf spring. To lock the shoe in the binding, moving the shoe vertically from top to bottom causes separation of the pins by warping the vertical parts of the leaf spring. In order to remove the skis, the user must manually warp one of the two vertical parts which is extended to form a lever, this aims to release the pin from the recess of the shoe in which it is inserted. These front units also require the presence of hollow inserts placed on both sides of the front end of the shoe. The disadvantages of this type of binding are:

- its significant weight in relation to the invention, especially if the leaf spring is made of metal.
- that snow, ice and/or mud can accumulate in the hollow inserts in the shoe while the user is walking without having skis attached to the shoes, making it impossible or difficult to clip into the skis during the clipping in stage.
- the reduction in rigidity of the leaf spring, especially when it is made of carbon fibres, owing to the fatigue stress of numerous clippings in, unclippings and vibrations.
- the leaf spring's vulnerability to impact and high mechanical stress, especially when it is made of carbon fibres.

These two front unit families that are currently on the market share a certain number of problems linked to usage and reliability. The invention provides a solution to the problems cited above:

- the invention is very light weight, due to its mechanism concept of retractable pins hidden inside the material of the shoe that does not lead to, or leads to very little, excess weight because its volume is the same as the material removed from the shoe. The geometry of the invention's mechanism is such that the interactive forces between the different parts are all oriented along the same axis, enabling the size of the parts to be minimised and thus limiting the weight of the assembly.
- the invention does not require a hollow insert inside the shoe, which eliminates the problem of filling with snow, ice and/or mud when the user is walking without having the skis attached to the shoes.
- due to a mechanical guidance system, the invention enables the shoe to be guided until it is fully engaged in the front unit, offering the user a precise way to position the shoe during the whole engagement phase, in order to facilitate the clipping in action.
- the invention enables reliability problems due to fatigue stress to be eliminated because none of the invention's structural components can be warped.
- the invention has a high resistance to impact and mechanical stress because its parts are made from metallic products that are known for being more robust than carbon fibre-based materials.

The invention is a concept based on a two-part system, one called the "retractable pins", housed in the front end of the shoe, and the other called the "front unit", fixed onto the sliding or rolling device.

According to a first aspect of the invention there is provided a retractable pins device, capable of being housed within a sports shoe, comprising two pins intended each to be inserted into a recess of a front unit, characterised in that it comprises two pins that are each able to slide at least 1.5 mm into a bushing, and a spring which acts to separate the two pins.

The retractable pins device may be hidden in the toe end of a sports shoe, traversing the width of the shoe along an axis transverse to the walking direction and approximately parallel to the shoe's sole. It is an insert comprising two retractable pins whose ends laterally extend by at least 1.5 millimetres from the front end of the shoe, each guided within a bushing, and a spring placed between the two pins that exerts a force on each of the pins acting to separate them.

The bushings may each comprise a collar which can contact a partial boss on the front unit, forming a mechanical sole holder, with the purpose of preventing the downward vertical movement of the shoe during its engagement with the front unit, and of adequately positioning the shoe so that the pins can penetrate into the recess of the front unit.

The pins may each comprise a fillet radius or chamfer between the end of the pin on the exterior side of the shoe and the cylindrical part which is guided within the bushing. This fillet or chamfer assists the insertion of the pin into the recess of the front unit when clipping in (stepping in), and enables safe unclipping (safety release) according to the method in variants 1 and 2 which provides a safe unclipping system in the event the user accidentally falls.

The mechanism assembly may be integrated into a sleeve, which is threaded at each end and into which the bushings are screwed. The assembly can be integrated into the toe end of the sports shoe either by gluing, pressing, or screwing.

The toe end of the sports shoe is shaped in such a way that the retractable pins part can be inserted therein. The lateral parts of the toe end of the shoe preferably each comprise a flat area, parallel to each other and perpendicular to the axis of the pins, in order to create a contact area for the collar of the bushing on the shoe during assembly by the screwing of the bushing into the sleeve.

According to a second aspect of the invention there is provided a front unit. Preferably the front unit according to the second aspect is characterised in that it comprises a rigid U-shaped frame, a recess on each of the vertical parts of the frame capable of engaging with the pin of the shoe, and a release system embedded in each recess, composed of or comprising a screw, a button and a gasket, said release system being able to move at least 1.5 mm along the axis of the recess.

The axis of the recess is preferably equal to the axis of the pins of the retractable pins device or a sports shoe having lateral pins, when the device or shoe is clipped in the front unit and ready for use, i. e. equals a rotational axis of the sports shoe about the front unit during walking. Thus, the axis of the recess is preferably oriented horizontally and transverse or orthogonal to a forward-backward direction.

The front unit, fixed onto the sliding or rolling device, is a rigid U-shaped frame comprising a recess in each of its vertical parts, whose axis is transverse to the direction of walking and approximately parallel to the sliding or rolling device into which the retractable pin is inserted during clipping in. The engagement of the shoe into the front unit is carried out by movement of the shoe from top to bottom.

The U-shaped frame preferably comprises, on the end of each of its vertical parts, a groove in the shape of a sloping ramp so as to guide and drive the pin towards the inside of the shoe, during movement from top to bottom of the said shoe, in an intermediate phase of engagement into the front unit.

The U-shaped frame may further comprise a mechanical sole holder on each of its vertical parts capable of engaging with the collar of the bushing, whose function is to prevent the downward vertical movement of the shoe during its engagement into the front unit, so that the pin is correctly positioned for insertion into the recess.

A front unit according to the second aspect of the invention, in particular a front unit as claimed in at least one of claims 1 to 9, may comprise a partial boss on one or each of the vertical parts of the frame and below the recess, wherein the partial boss may have a concave-shaped upper side preferably describing a part of a circle that is concentric with respect to the axis of the recess. Such front unit is prepared to receive a collar of a retractable pins device of the first aspect within the concave-shaped upper side of the partial boss and to carry or support such collar in order to reduce forces acting to the pins in a direction transverse to the axis of the pins, when weight of the user is applied during use.

The front unit may comprise a downhill safety system in order to ensure releasing of the shoe from the front unit in the event the user falls when downhill skiing. For this, the frame of the front unit may comprise a pivoting stirrup or a slider which can, when it is positioned in the "downhill" position, reduce the length of insertion of the pins of the shoe into the recesses of the front unit.

Unclipping is carried out manually by the user by exerting pressure on two buttons present on the front unit, which has the effect of pushing the retractable pins towards the inside of the shoe and thus releasing the shoe from the front unit. This action is done with a pinching movement using two fingers: the thumb and preferably the index finger on the same hand.

In a preferred embodiment of the present invention, the release system comprises a button slidably mounted within the recess to move along an axis of the recess. The button may have an outer surface exposed to be pressed directly by a user's fingers to move the button along the axis of the recess towards the sports shoe such as to push the pins towards the sports shoe.

In a further preferred embodiment of the present invention, in the release position the button extends through the entire length of the recess such that the recess is closed and a surface of the button facing the boot is flush with an inner rim portion of the recess. Moreover, in the release position the button may be fully sunken within the recess and a surface of the button facing away from the boot may be flush with an outer rim portion of the recess. Thus the size of the release system in a direction of the axis of the recess can be minimized. The recess can be a formed as a through-hole within the vertical portion of the frame.

In a further preferred embodiment of the present invention, the bushing is disposed within a sleeve and the spring is inserted into the interior of the sleeve.

According to a third aspect of the invention, there is provided a binding device for holding a sports shoe on a gliding or rolling device, characterised in that it comprises a front unit according to the second aspect of the present invention.

According to a fourth aspect of the present invention, there is provided a releasing method of a sports shoe from a gliding or rolling device, characterised in that the user carries out with the same hand a pinching movement with the thumb and another finger on the buttons of a front unit, which has the effect of releasing the shoe from the front unit.

According to a fifth aspect of the invention there is provided an assembly comprising a retractable pins device according to the first aspect of the invention, wherein the bushings each comprise a collar, a front unit according to the second aspect of the invention, wherein the frame comprises a partial boss on each of its vertical parts and below the recess, and wherein when the retractable pins device is clipped in and the pins are received within the recesses, the collars contact the upper sides of the partial bosses. Thus, when the sports shoe is clipped in and the pins are received within the recesses, the collars contact the upper sides of the partial bosses such that the partial bosses support the weight of the shoe and the user during walking and/or downhill. Thus the weight of the shoe and the user is at least partially carried by the collars such that forces applied to the pins in a direction transverse to the axis of the pins are reduced. Preferably the upper side of the partial bosses have a concave shape corresponding to the outer convex shape of the collars such that the collars fit into the concave shape of the bosses and are reliably hold and supported even if the collars rotate together with a sports shoe according to the rotation of the shoe about the axis of the pins during walking.

According to a sixth aspect of the invention there is provided a gliding or rolling device, characterised in that it is equipped with a front unit according to the second aspect of the invention.

According to a seventh aspect of the invention there is provided an assembly for the binding of a sports shoe on a gliding or rolling device, comprising a front unit according to the second aspect of the invention presenting a recess on each of its vertical parts, and a shoe, in particular a shoe according to claim 13 or claim 14, comprising a pin on each of its front lateral parts, characterised in that the recess is capable of receiving the pin and in that the front unit is capable of receiving the shoe.

In the following, preferred embodiments of the present invention are described with reference to the attached drawings in which:

FIG. 1 shows a three-dimensional view of an assembly according to the invention, comprising a sports shoe (30) attached to a front unit (40), a heel end (50), and a gliding or rolling board (20).

Figure 1A:
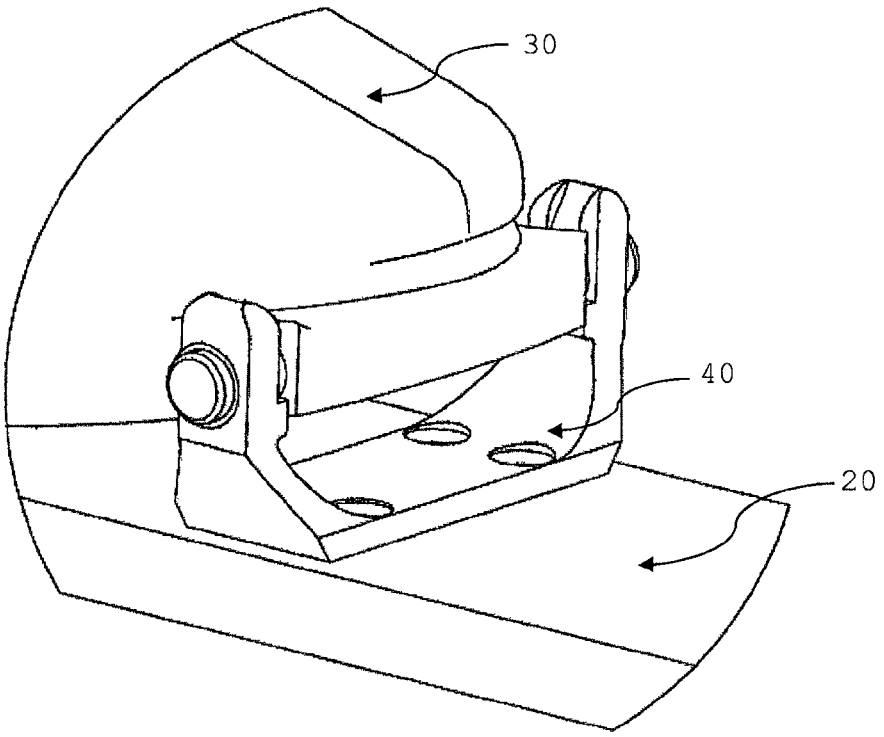

FIG. 1*a* is an enlarged view of the area marked A in FIG. 1.

Figure 2:
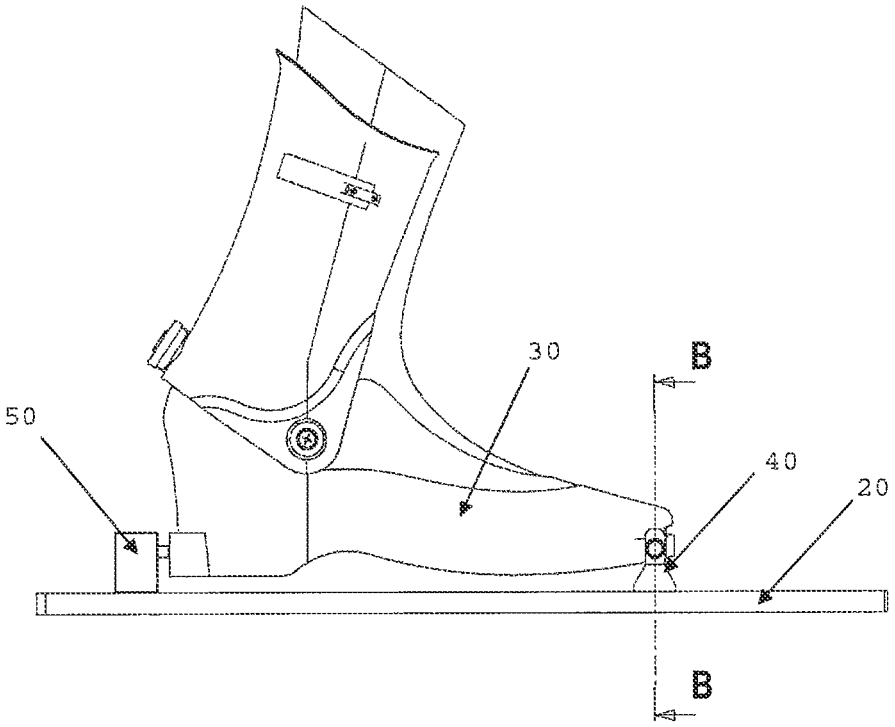

FIG. 2 shows the side view of an assembly according to the invention, comprising a sports shoe (30) attached to a front unit (40), a heel end (50), and a gliding or rolling board (20).

Figure 2A:
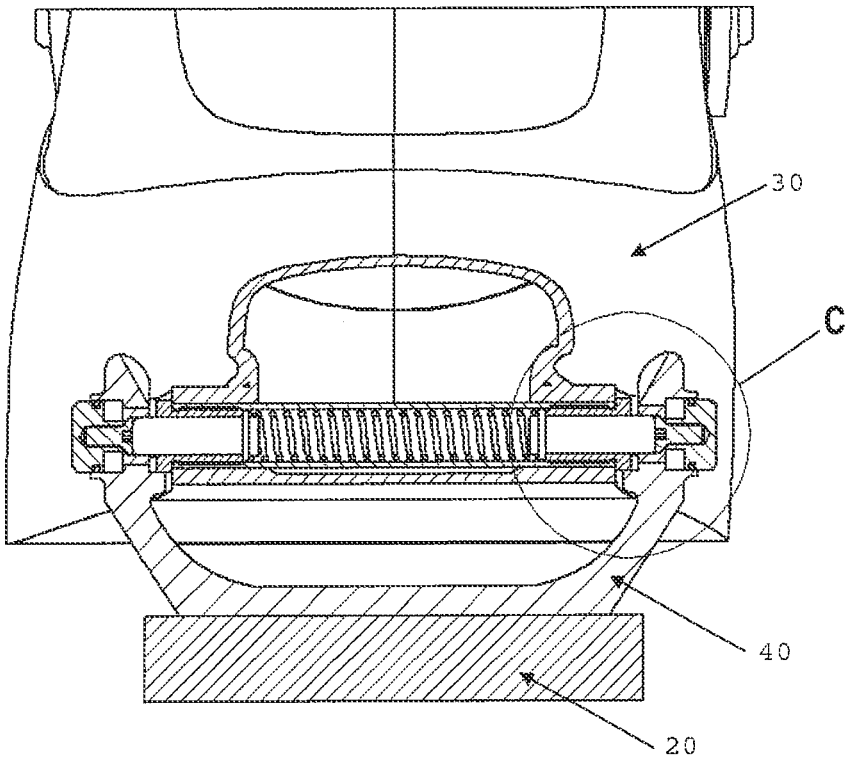

FIG. 2*a* shows the sectional view along axis B-B as defined in FIG. 2.

Figure 2B:
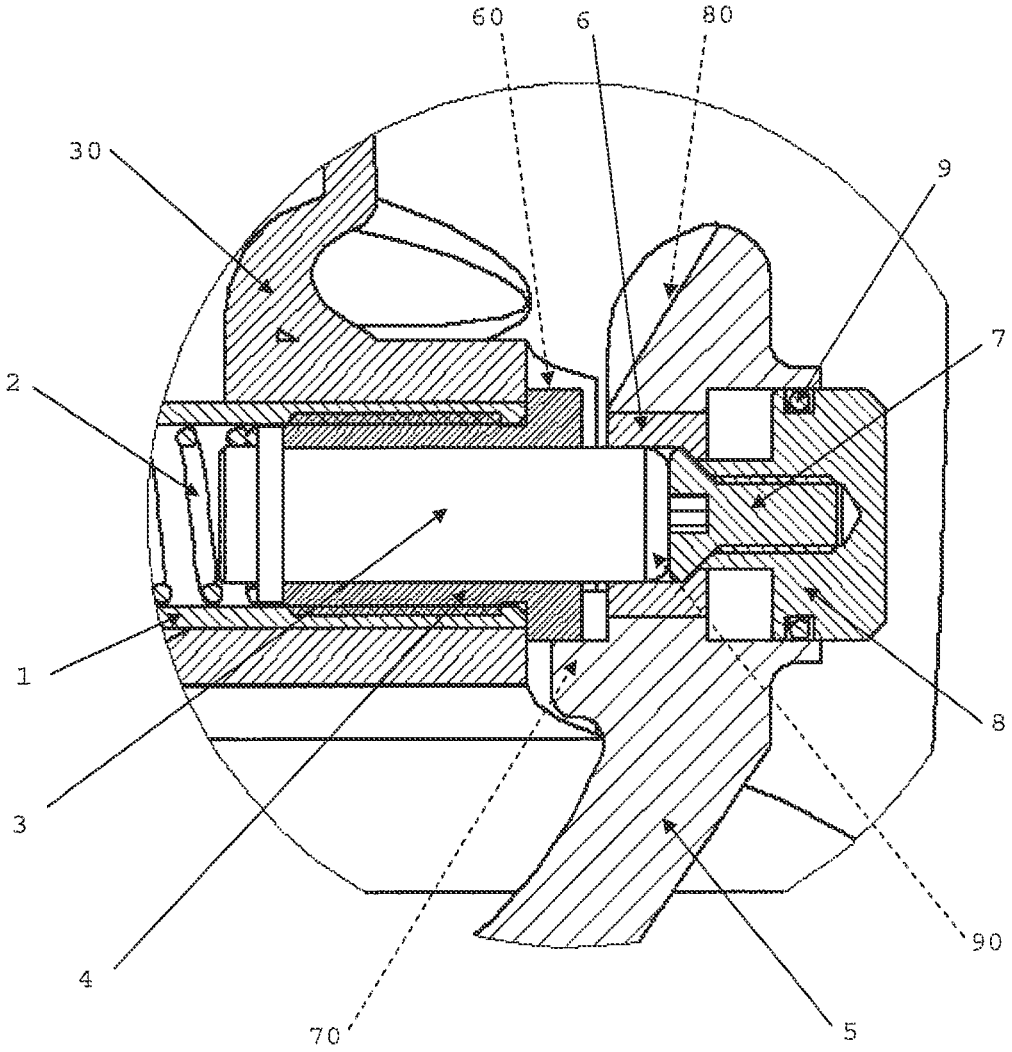

FIG. 2*b* is an enlarged view of the area marked C in FIG. 2*a*. The solid arrows each point to a part and the dashed arrows each point to a particular aspect of a part.

Figure 3:
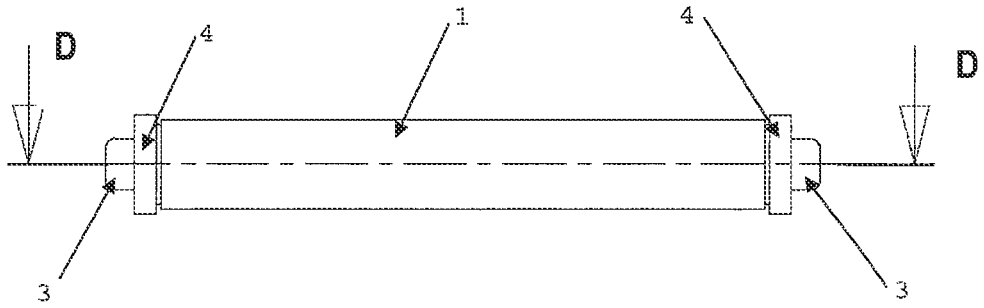

FIG. 3 shows a frontal view in isolation of the subset of retractable pins according to the invention.

Figure 3A:
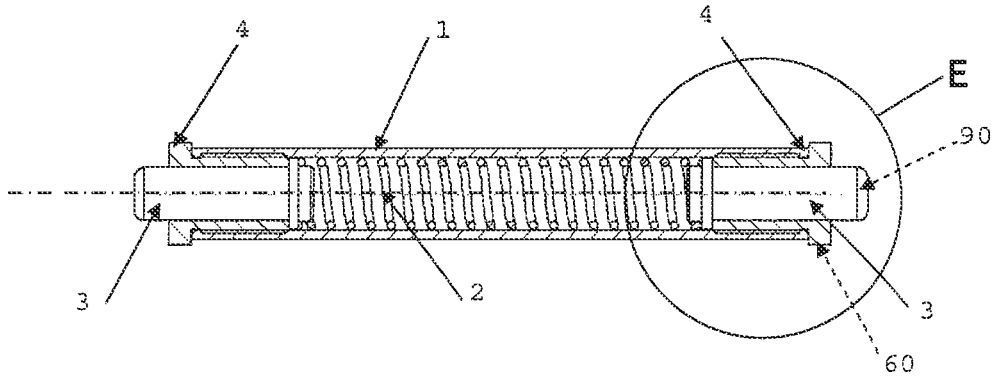

FIG. 3*a* shows a sectional view of the subset of retractable pins according to the invention, along axis D-D as defined in FIG. 3.

Figure 3B:
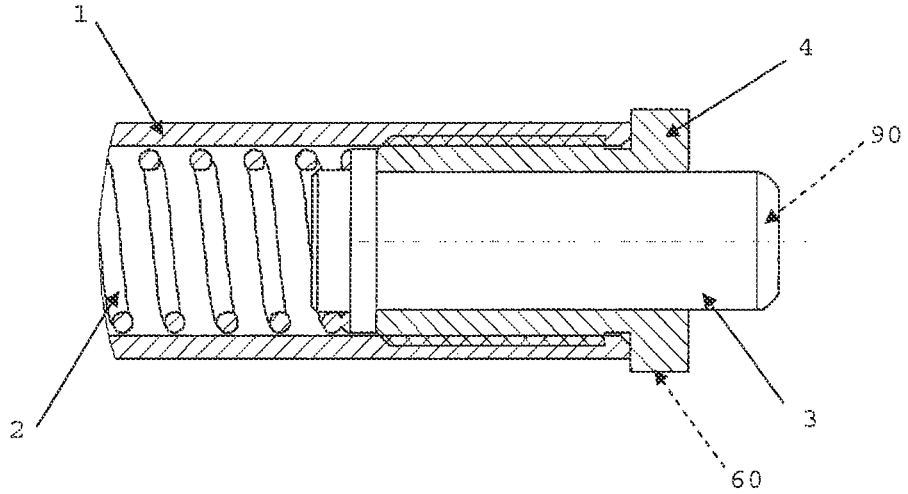

FIG. 3*b* is an enlarged view of the area marked as E in FIG. 3*a*. The solid arrows each point to a part and the dashed arrows point to a particular aspect of a part.

Figure 4A:
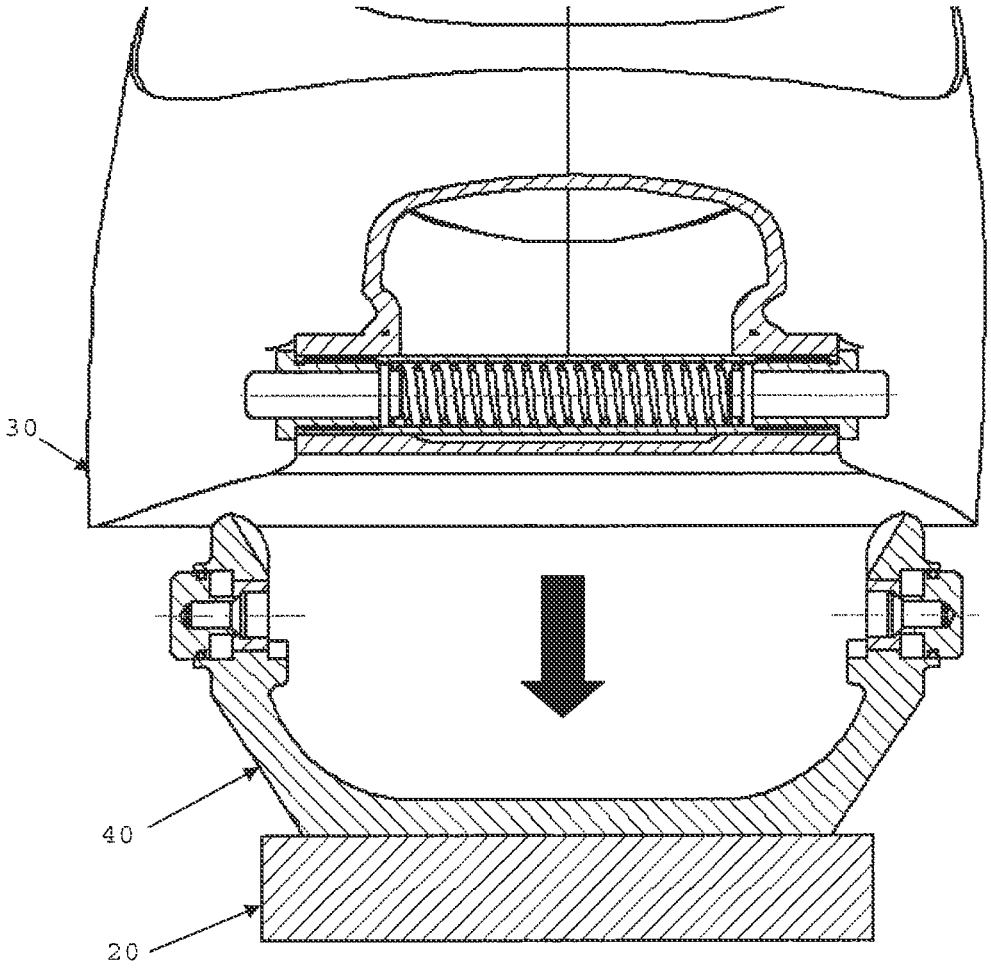

FIG. 4*a* shows a sectional view, along axis B-B as defined in FIG. 2, of an assembly according to the invention comprising a sports shoe (30) that is not clipped into a front unit (40) and a gliding or rolling board (20). The central arrow shows the movement from top to bottom of the shoe in order to clip it into the front unit.

Figure 4B:
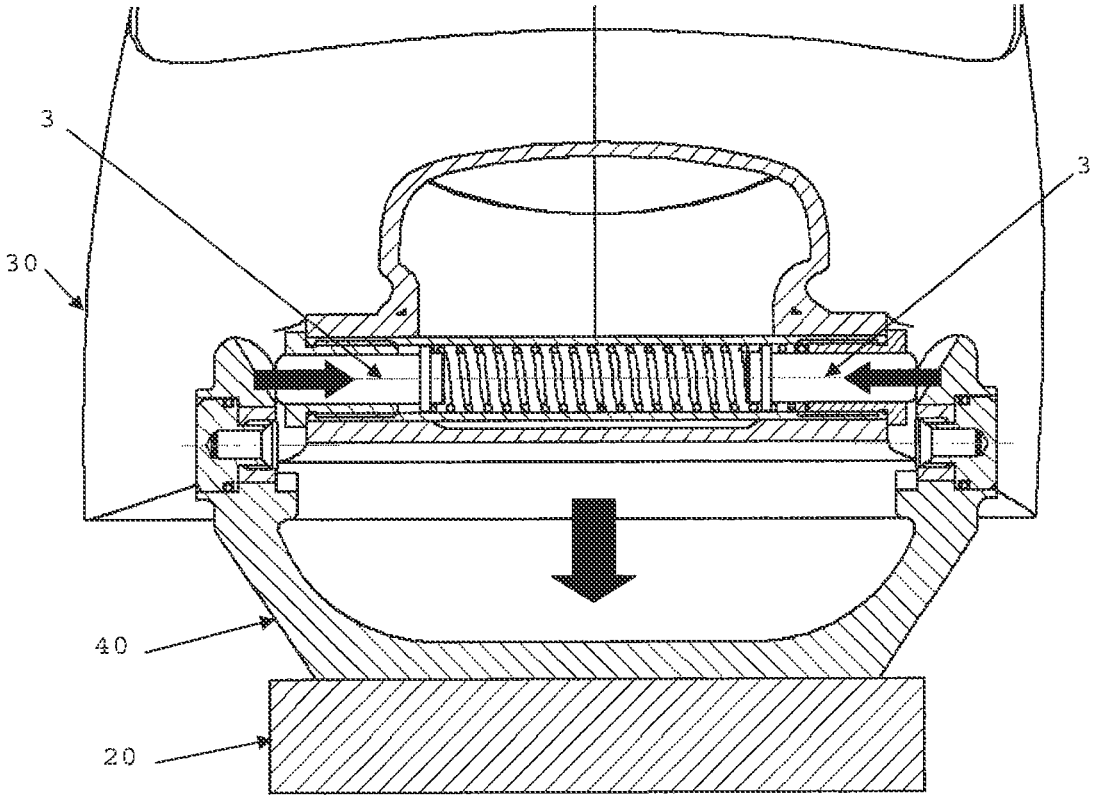

FIG. 4*b* shows a sectional view, along axis B-B as defined in FIG. 2, of an assembly according to the invention comprising a sports shoe (30) in an intermediary clipping in position to the front unit (40) and a gliding or rolling board (20). The central arrow shows the movement from top to bottom of the shoe, and the two lateral arrows show the movement of the pins (3) towards the inside of the shoe, this in an intermediary clipping in stage of the shoe into the front unit.

Figure 4C:
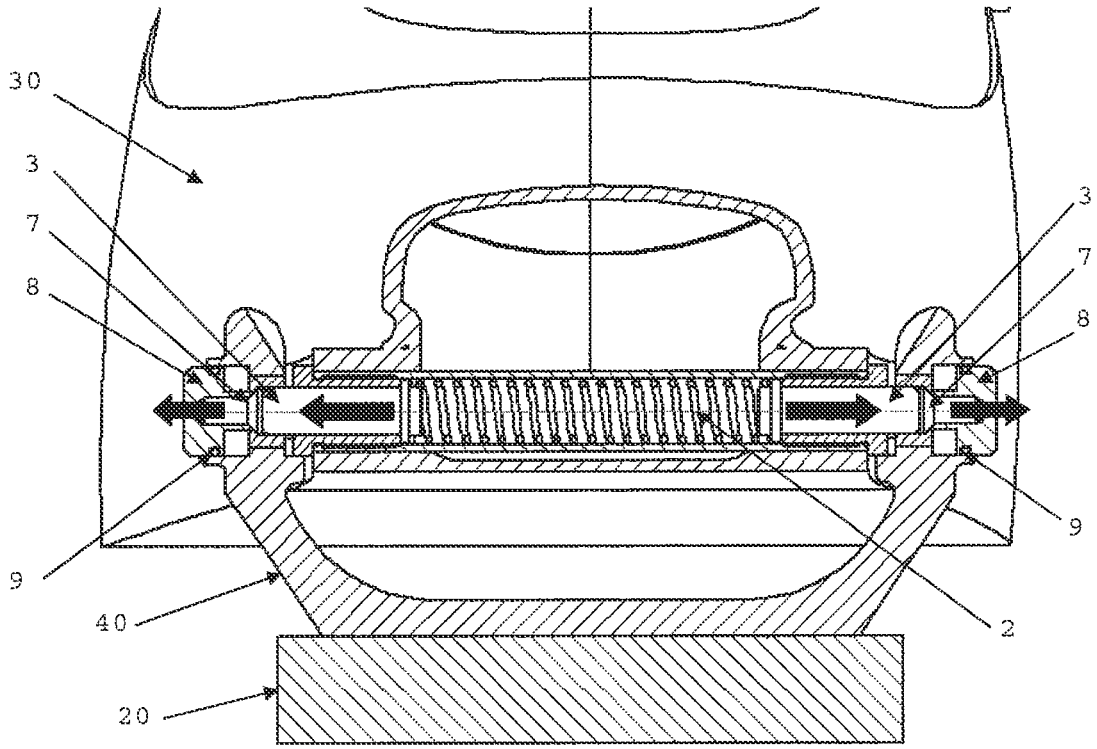

FIG. 4*c* shows a sectional view, along axis B-B as defined in FIG. 2, of the assembly comprising a sports shoe (30) in a position clipped into the front unit (40). The lateral arrows show the movement of the pins (3) and the release systems, each comprising the screw (7), the button (8) and the gasket (9), under the action of the spring (2), in a final clipping in stage of the shoe into the front unit.

Figure 5A:
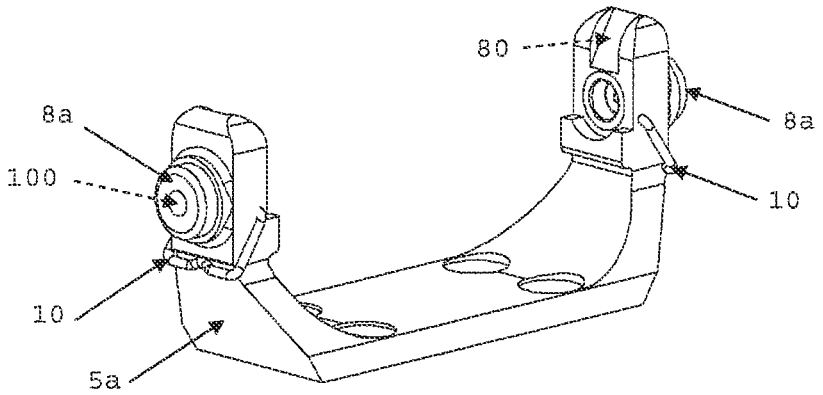

FIG. 5*a* shows a three-dimensional view of variant 1 of the front unit in the "walking" position. The solid arrows each point to a part and the dashed arrows point to a particular aspect of a part.

Figure 5B:
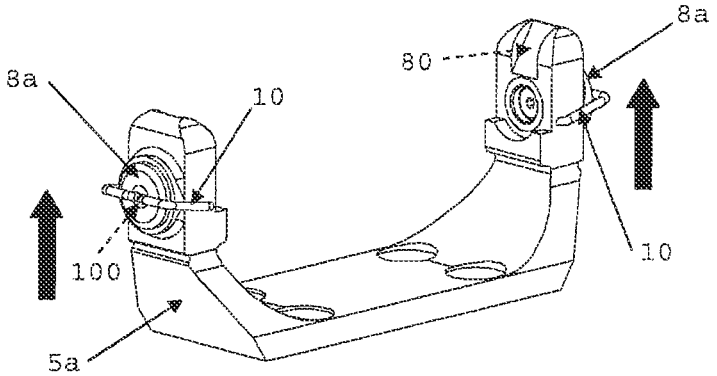

FIG. 5*b* shows a three-dimensional view of variant 1 of the front unit in the "downhill" position. The large arrows show the direction of movement of the stirrups (10) for adoption of the "downhill" position. The solid arrows each point to a part and the dashed arrows point to a particular aspect of a part.

Figure 5C:
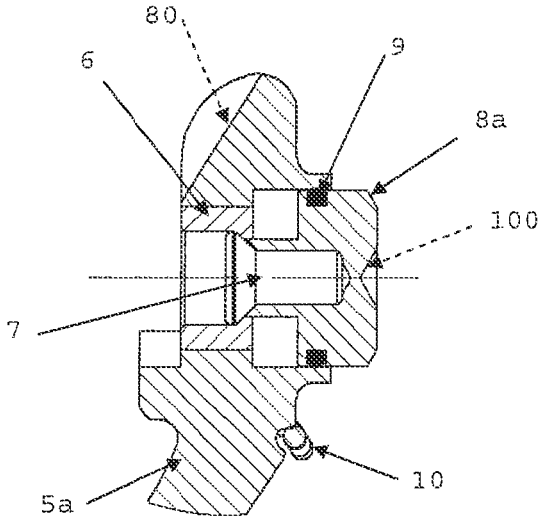

FIG. 5*c* shows a sectional view of the vertical part of variant 1 of the front unit in the "walking" position. The solid arrows each point to a part and the dashed arrows point to a particular aspect of a part.

Figure 5D:
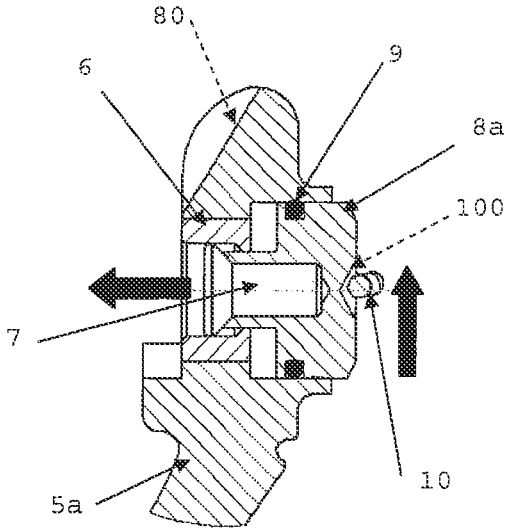

FIG. 5*d* shows a sectional view of the vertical part of variant 1 of the front unit in the "downhill" position. The large vertical arrow shows the direction of movement of the stirrup (10) for adoption of the "downhill" position, and the large horizontal arrow shows the movement of the release system during adoption of the "downhill" position. The solid arrows each point to a part and the dashed arrows point to a particular aspect of a part.

Figure 6A:
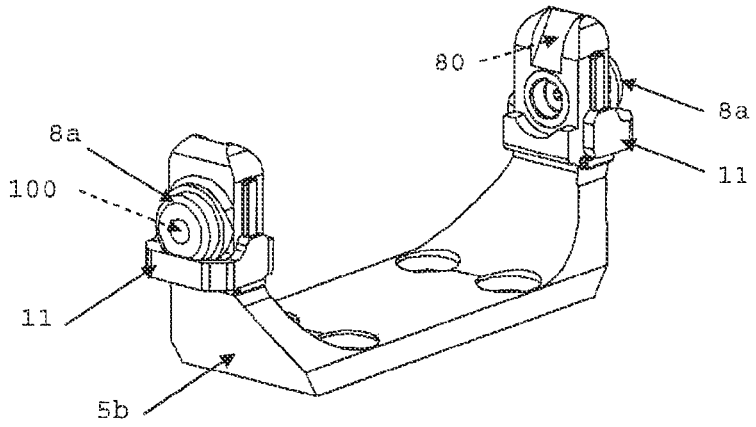

FIG. 6*a* shows a three-dimensional view of variant 2 of the front unit in the "walking" position. The solid arrows each point to a part and the dashed arrows point to a particular aspect of a part.

Figure 6B:
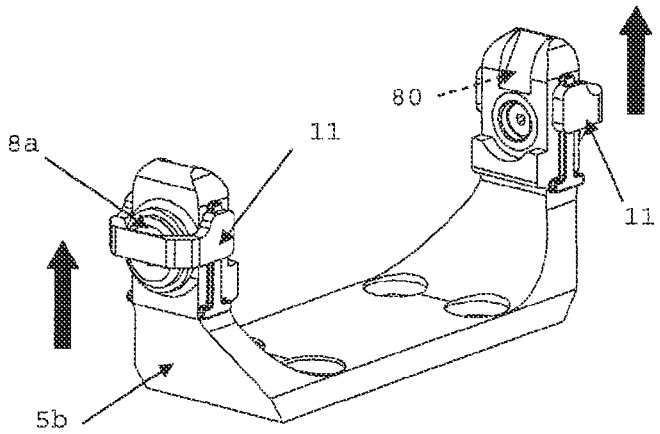

FIG. 6*b* shows a three-dimensional view of variant 2 of the front unit in the "downhill" position. The large arrows show the direction of movement of the slider (11) for adoption of the "downhill" position. The solid arrows each point to a part and the dashed arrows point to a particular aspect of a part.

Figure 6C:
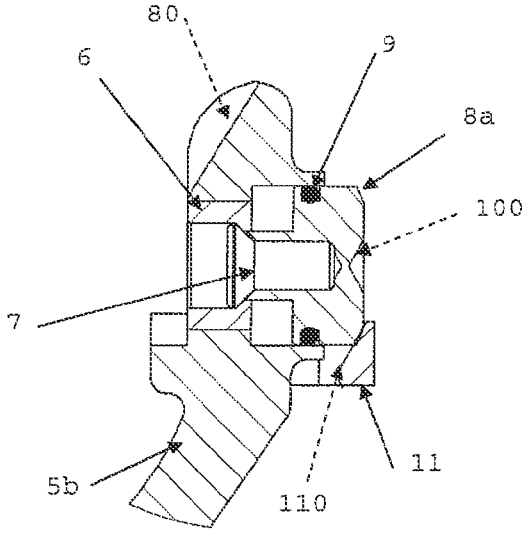

FIG. 6*c* shows a sectional view of the vertical part of variant 2 of the front unit in the "walking" position. The solid arrows each point to a part and the dashed arrows point to a particular aspect of a part.

Figure 6D:
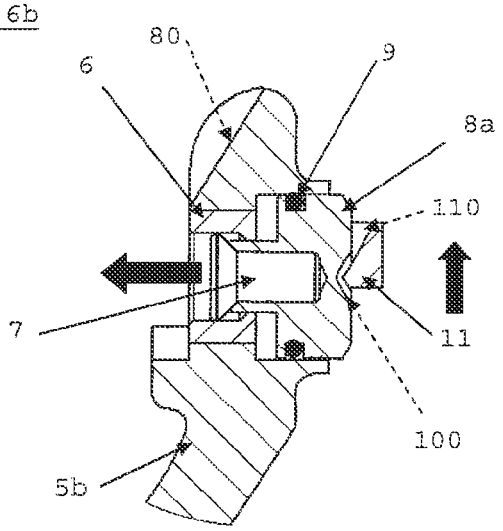

FIG. 6*d* shows a sectional view of the vertical part of variant 2 of the front unit in the "downhill" position. The large vertical arrow shows the direction of movement of the slider (11) for adoption of the "downhill" position and the horizontal arrow shows the movement of the release system during adoption of the "downhill" position. The solid arrows each point to a part and the dashed arrows point to a particular aspect of a part.

The invention can be carried out according to an embodiment described below. The binding comprises two distinct assemblies:

according to FIGS. 2*a*, 2*b*, 3, 3*a* and 3*b*, an assembly called "retractable pins", which is integrated into the front end of the shoe. This assembly comprises a sleeve (1) made from a hard material and threaded into each of its extremities, a spring (2) placed into the sleeve (1), two bushings (4) connected by screwing into each extremity of the sleeve (1), and two pins (3) that each slide into a pivot joint sliding at least 1.5 mm into the bushing (4). The spring (2) exerts an axial force on the two pins (3) acting to separate them. The sleeve (1) may be connected by either gluing, pressing or screwing into a hole crossing the width of the front end of the shoe along an axis transverse to the direction of walking and approximately parallel to the sole of the shoe. The spring (2) may be mounted with a pretension force and its compressive movement from the pretensioned state to the point of maximum compression is at least equal to 3 mm. The bushing (4), made from a hard material, may have a collar capable of engaging with the recess (6) of a front unit, may have a transverse groove on the collar enabling the connection of a clamping device, may be threaded on the exterior diameter, and may comprise a smooth central axial hole sized with a minimum clearance to ensure the sliding of the pin (3). The bushing (4) is preferably connected by screwing it into the sleeve (1) until the collar is in contact with the shell of the shoe (30). The end of the pin (3) on the exterior side of the shoe may comprise a fillet radius between the end and the cylindrical part. The other side of the pin may comprise a male spigot over which the end of the spring is slotted. Stopping movement of the pin from the interior to the exterior of the shoe can be ensured by a collar machined onto the pin, which contacts the bushing (4).

According to FIGS. 1, 1*a*, 2, 2*a* and 2*b*, an assembly (40) called the "front unit", connected by screwing onto the gliding or rolling device (20) comprises a rigid frame (5), two recesses (6), and two release systems, each preferably comprising a button (8), a screw (7) and a gasket (9). The U-shaped frame (5) may comprise 4 countersunk holes on its base offering the option of screwing it onto the gliding or rolling device (20); its vertical parts are preferably narrower than the sole and may comprise, at their extremity, a groove serving as a guide for the pins (3) during the clipping of the sports shoe into the front unit (40); a concave-shaped partial boss situated below each recess (6) preferably forms a mechanical stop in order to prevent movement of the bushing (4) during the clipping in of the sports shoe (30) into the front unit (40). The recess (6) may be drilled to a slightly larger diameter than that of the pin (3) to enable insertion of the latter into the recess (6). The release system may contained by its mounting in the recess (6), but can slide a distance of at least 1.5 mm on its axis, the assembly serving to push the pins (3) towards the inside of the shoe when the user presses on the buttons (8), with the aim of releasing the shoe (30) from the front unit (40).

As can be seen in FIGS. 2*b* and 4*c*, when the sports shoe (30) is clipped in and the pins (3) are received within the recesses (6), the collar (60) contacts the upper side of the partial boss (70) such that the partial boss (70) supports the weight of the shoe and the user during walking and/or downhill. Thus the weight of shoe and the user is at least partially carried by collar (60) such that forces applied to the pins (3) in a direction transverse to the axis of the pins (3) are reduced. Preferably the upper side of the partial boss (70) as a concave shape corresponding to the outer convex shape of the collar (60) such that the collar (60) fits into the concave shape of the boss (70) and is reliably hold and supported even if the the collar rotates according to the rotation of the shoe about the axis of the pins (3) during walking.

In its basic version, the front unit sub-assembly does not have a safe unclipping system for falls and can only be unclipped manually. The safety system for downhill skiing described herein gives the option of unclipping in the event the user falls. This system is activated by the user for going down a slope and when the shoe is clipped into the front unit. The front unit is said to be in the "downhill" position when this safety system is activated and in the "walking" position when it is deactivated. The principle of this safety system relies on a part integrated into the front unit which, when the user moves it, reduces the length of penetration of the pins (3) into the recess (6). When the front unit is in the "walking" position, the pin (3) fully protrudes into the recess (6), and when it is in the "downhill" position, the pin (3) only partially protrudes, approximately halfway. In the "downhill" position, the partial protrusion of the pins (3) in the recesses (6), combined with the presence of a fillet radius (90) on the extremity of the pins (3), enables unclipping of the shoe in case of significant twisting or upward force. The force needed for triggering is set by the stiffness of the spring (2).

There are two variants for the adoption of the "downhill" position:

variant 1, according to FIGS. 5*a*, 5*b*, 5*c* and 5*d*, comprises a stirrup (10) made of spring wire fixed into 2 holes in a pivot joint on each vertical part of the frame (5*a*), which can be turned by the user towards the bottom to activate the "walking" position, and towards the top to activate the "downhill" position whereby the stirrup clips onto the button (8*a*) which comprises a cavity (100) capable of receiving the stirrup (10), which has the effect of pushing back the release system and therefore the pin (3). In order for the "downhill" position to be fully activated, all stirrups (10) must be in the high position.

variant 2, according to FIGS. 6*a*, 6*b*, 6*c* and 6*d*, comprising a slider (11) placed on each vertical part of the frame (5*b*), which can be moved by the user towards the bottom to activate the "walking" position, and towards the top to activate the "downhill" position whereby the slider clips onto the button (8*a*) which comprises a cavity (100) capable of receiving the slider (11), which has the effect of pushing back the release system and therefore the pin (3). In order for the "downhill" position to be fully activated, all the sliders (11) must be in the high position.

The invention claimed is:

1. A front unit of a binding for holding a sports shoe on a gliding or rolling device, the front unit comprising:

a frame having a recess in a vertical portion for receiving a pin projecting laterally from the sports shoe; and, a release system housed in the recess of the frame and movable within the recess along an axis of the recess to push the pin towards the sports shoe to release the sports shoe from the front unit.

2. The front unit of claim 1, wherein:

the recess comprises a first recess and a second recess;

the frame is a rigid U-shaped frame comprising first and second vertical parts, wherein the first recess is disposed on the first vertical part and the second recess is disposed on the second vertical part of the frame and each recess of the first and second recesses is capable of engaging with the pin of the sports shoe; and the release system is embedded in each of the first and second recesses, said release system being able to move at least 1.5 mm along an axis of each of the first and second recesses and said release system further comprising a screw, a button and a gasket.

3. The front unit of claim 1, wherein the frame further comprises first and second vertical parts and a groove arranged on at least one of the first and second vertical parts in the form of a sloping ramp configured to guide and push the pin of the sports shoe towards an interior of the sports shoe during a clipping operation comprising moving the sports shoe from a top position to a bottom position relative to the front unit.

4. The front unit of claim 1, wherein the frame further comprises first and second vertical parts and at least one partial boss on at least one of the first and second vertical parts of the frame, wherein the at least one partial boss is:

arranged below the recess and capable of engaging with one of a collar of a bushing of the sports shoe and a boss of the sports shoe;

configured to stop a vertical movement of the sports shoe when the sports shoe is moved from top to bottom in the front unit during a clipping operation into the front unit, so that the pin is correctly positioned for insertion into the recess; and concave or flat in shape.

5. The front unit of claim 1, further comprising a safety system for going downhill, the safety system comprising a mechanism for reducing a length of penetration of the pin into the recess when the sports shoe is clipped into the front unit such that when the safety system is activated, the safety system facilitates release of the sports shoe from the front unit.

6. The front unit of claim 5, wherein:

the frame further comprises a first vertical part and a second vertical part;

the safety system for going downhill further comprises a first bracket placed on the first vertical part and a second bracket placed on the second vertical part;

each of the first and second brackets is able to pivot around a respective axis that is approximately parallel to a direction of walking and to the gliding or rolling device; and each of the first and second brackets is able to be arrested into a respective cavity of a respective button of the safety system when the safety system is activated, in which each of the first and second brackets extends to push back each respective button towards an interior of the sports shoe, thus reducing the length of penetration of the pin into the recess.

7. The front unit of claim 5, wherein:

the frame further comprises first and second vertical parts; and the safety system for going downhill further comprises a first slider placed on the first vertical part of the frame and arranged to interact with a first button of the safety system, and a second slider placed on the second vertical part of the frame and configured to interact with a second button of the safety system, wherein each of the first and second sliders is able to slide along each respective one of the first and second vertical parts of the frame, each of the first and second sliders is fitted with a sloping ramp, and each of the first and second sliders is able to be slotted into a respective cavity of one of the first and second buttons of the safety system when the safety system is activated, in which each of the first and second sliders stretches to push back each respective button of the first and second buttons towards an interior of the sports shoe, thus reducing the length of penetration of the pin into the recess.

8. A front unit of a binding for holding a sports shoe on a gliding or rolling device, the front unit comprising:

a frame having a recess in a vertical portion of the frame for receiving a pin projecting laterally from a sports shoe; and a release system housed in the recess of the frame and movable within the recess along an axis of the recess to push the pin towards the sports shoe to release the sports shoe from the front unit; wherein the front unit can be set to:

a) a walking position suitable for walking, in which the release system allows a penetration length of the pin of the sports shoe into the recess according to a first predetermined depth of the recess;

b) a downhill position suitable for downhill, in which the release system reduces the penetration length of the pin of the sports shoe into the recess by reducing the depth of the recess to a second predetermined depth smaller than the first predetermined depth; and c) a release position suitable for stepping into or out of the binding, in which the release system further reduces the depth of the recess until the pin of the sports shoe is released from the recess.

9. The front unit of claim 8, further comprising a locking mechanism for locking the front unit in the downhill position.

10. A retractable pins device capable of being housed within a sports shoe, the device comprising:

two pins each adapted to be inserted into a recess of a front unit, wherein the two pins are each able to slide at least 1.5 mm into a bushing of the sports shoe, wherein the bushing comprises a collar capable of engaging with a partial boss extending laterally toward the sports shoe from a vertical portion of a frame of the front unit; and a spring which acts to separate the two pins.

11. The retractable pins device of claim 10, wherein:

each of the two pins comprises a cylindrical part and an extremity on an exterior side of each of the two pins relative to the sports shoe, and each of the two pins comprises a rounding or a chamfer between its cylindrical part and its extremity, said rounding or chamfer being capable of engaging with the recess of the front unit such that the rounding or chamfer facilitates insertion of each of the two pins into the recess and further facilitates safe unclipping of the front unit.

12. A sports shoe comprising:

two lateral front parts, each of the two lateral front parts comprising a pin and a bushing, each pin being capable of insertion into a respective recess of a front unit and being able to slide at least 1.5 mm along its own respective axis, and each bushing comprising a collar capable of engaging with a partial boss extending laterally toward the sports shoe from a vertical portion of a frame of the front unit; and a spring which acts to separate the pins.

13. The sports shoe of claim 12, further comprising:

on each of the two lateral front parts, a boss capable of engaging with the partial boss of the front unit.

14. An assembly comprising:

a) a front unit of a binding for holding a sports shoe on a gliding or rolling device, the front unit comprising:

a frame having two vertical parts and two recesses, each of the two vertical parts having a respective recess of the two recesses for receiving one of two pins projecting laterally from the sports shoe, the frame further comprising a first partial boss and a second partial boss, the first partial boss being disposed on the first vertical part below a first recess of the two recesses, and the second partial boss being disposed on the second vertical part below a second recess of the two recesses, and a release system housed in each of the two recesses of the frame and movable within each of the two recesses along a respective axis of each of the two recesses to push each of the two pins towards the sports shoe in order to release the sports shoe from the front unit; and, b) a retractable pins device capable of being housed within the sports shoe, the retractable pins device comprising the two pins, each one of the two pins being adapted to be inserted into one of the recesses of the front unit, wherein the two pins are each able to slide at least 1.5 mm into a bushing of the retractable pins device, and a spring which acts to separate the two pins, wherein the bushing comprises a first collar and a second collar, the first collar disposed on a first side of the bushing and the second collar disposed on a second side of the bushing opposite the first side, wherein, when the retractable pins device is clipped in the front unit and the two pins are received within the two recesses, the first collar contacts an upper side of the first partial boss and the second collar contacts an upper side of the second partial boss.

15. The front unit of claim 1, wherein the pin projects laterally from an interior cavity of the sports shoe, and wherein the release system is configured to push the pin further into the interior cavity of the sports shoe.

16. The front unit of claim 1, wherein the recess further comprises a cylindrical interior surface configured to abut a cylindrical outer surface of the pin when the pin is received in the recess.

* * * * *